US005492072A

United States Patent [19]

Yamashita

[11] Patent Number: 5,492,072

[45] Date of Patent: Feb. 20, 1996

[54] HALF-TURN HOOK WITH LOOP POSITIONING SURFACES

[75] Inventor: Takashi Yamashita, Tokyo, Japan

[73] Assignee: Juki Corporation, Tokyo, Japan

[21] Appl. No.: 287,684

[22] Filed: Aug. 19, 1994

[30] Foreign Application Priority Data

Aug. 20, 1993 [JP] Japan ..... 5-045509 U

[51] Int. Cl.[6] ..... D05B 57/14

[52] U.S. Cl. ..... 112/228; 112/181

[58] Field of Search ..... 112/181, 182, 112/228, 230, 231, 235, 185, 187, 192, 232

[56] References Cited

U.S. PATENT DOCUMENTS

| | | | |
|---|---|---|---|
| 1,786,944 | 12/1930 | Hemleb | 112/181 |
| 2,332,964 | 10/1943 | Colegrove | 112/181 X |
| 2,873,706 | 2/1959 | Tateishi | 112/181 |
| 2,980,044 | 4/1961 | Parry | 112/181 X |
| 3,115,110 | 12/1963 | Ketterer | 112/181 |
| 3,145,673 | 8/1964 | Meloy, Jr. | 112/181 |
| 3,933,106 | 1/1976 | Murray | 112/235 |

*Primary Examiner*—C. D. Crowder
*Assistant Examiner*—Ismael Izaguirre
*Attorney, Agent, or Firm*—Finnegan, Henderson, Farabow, Garrett & Dunner

[57] ABSTRACT

A half-turn hook for positioning a needle thread loop between a needle and a bobbin at the time of stitching, the half-turn hook comprises a shuttle race body, a rotatable shuttle body, a bobbin and a shuttle race ring. The shuttle race body has a sliding surface on which a needle thread is slid in the beginning of stitching. The shuttle race ring has a cutout formed in its upper portion. In the half-hook, the surface where the shuttle body abuts against the shuttle race body and the end into which the rotating shuttle digs, in the cutout of the shuttle body race ring, is located closer to the rotating shuttle body than the sliding surface of the shuttle race body.

2 Claims, 7 Drawing Sheets

HALF-TURN HOOK WITH LOOP POSITIONING SURFACES

BACKGROUND OF THE INVENTION

The present device relates generally to half-turn hooks and more particularly to a half-turn hook fit for use in an automatic sewing machine.

DB-type half-turn hooks have conventionally been employed in automatic sewing machines. FIG. 6 is a top view of a DB-type half-turn hook of the sort mentioned above. As shown in FIG. 6, the DB-type half-turn hook has a shuttle race body 2, a shuttle body, a shuttle bobbin (not shown), which are provided in the shuttle race body 2, and a shuttle race ring 4. A cutout 6 for use in vertically passing a needle and a needle thread therethrough is formed in the top surface of the shuttle race body 2. And a cutout 32 is also formed in the shuttle race ring 4. Moreover, a sliding surface 10 is provided in the rear (upper side of FIG. 6) of the thread dividing portion 8 of the shuttle race body 2, the sliding surface 10 being smoothly finished.

When a machine using such a DB-type half-turn hook is employed for stitching purposes, a needle 16 is positioned between a needle thread loop 12 and a point where a bobbin thread on a bobbin 14 is guided outward. The DB-type half-turn hook in this case is assumed to be such that the needle thread loop 12, the needle 16 and the bobbin 14 are thus related to each other. In FIG. 7, reference numeral 18 denotes a bobbin thread, 20 a needle hole in the needle plate, and 22 a needle location.

FIGS. 8 to 10 illustrate a DB-type half-turn hook in such a state that stitching is started after the thread is cut: FIG. 8 is an elevational view; FIG. 9 a perspective view; and FIG. 10 a partial top view as viewed from the direction of an arrow C. In these drawings, reference numeral 24 denotes a shuttle race cap, 26 a shuttle body, and 27 a needle plate. A needle thread 28 moves along the sliding surface 10 formed on the side of the needle thread 28 of the thread dividing portion 8 of the shuttle race body 2.

When the automatic sewing machine employing such a DB-type half-turn hook is used for stitching, different seams are formed, depending on the cloth-feeding direction. FIG. 11 illustrates seams of different types: FIG. 11(A) shows a perfect stitch; and FIG. 11(B) a hitch stitch; more specifically, the needle thread 28 and the bobbin thread 18 become twisted and entangled in the former case, whereas both threads become entangled in the form a chain in the latter case.

In the case of the perfect stitch, good seams are formed because needle threads are smoothly lifted with excellent tightness of stitches during the stitching operation. In the case of the hitch stitch, on the other hand, a kind of knot is formed by a ring of needle thread 28 and this not only hampers the lifting of the needle thread 28 but also deteriorates the tightness of stitches, though it is fit for turning the course as threads are hardly loosened. The perfect stitch is needed in the beginning of stitching in the case of straight stitch and in order to prevent threads from loosening in the beginning or at the end of stitching, it is preferred to turn the course by means of the hitch stitch. Therefore, the DB-type half-turn hook has heretofore been used.

Notwithstanding, the perfect stitch ought to be made in different stitching directions in cases where the crosswise stitch (zigzag chain stitch), the pattern stitch and so forth are carried out. Since the half-turn hook for use in the conventional automatic sewing machine has been of the aforementioned DB type, a mixture of perfect and hitch stitches occurs in some stitching directions and consequently poses a serious problem in stitching quality.

FIG. 12 illustrates an example different from what is shown in FIG. 7, wherein the needle thread loop 12 is located between the needle 16 and the point where the bobbin thread on the bobbin 14 is guided outward. A hook having the needle thread loop 12, the needle 16 and the bobbin 14 in this relationship to each other is called a DP type. The use of the DP-type half-turn hook justifies the perfect stitch in either case of feeding cloth forward or backward. In order to make certain of the kinds of seams prepared at the time of pattern work, a circular seam approximately 120 mm in diameter was formed at a pitch of approximately 2 mm. FIG. 13 shows the test results. FIG. 13(A) refers to a case where the stitching direction is set clockwise (cloth-feeding direction is counterclockwise) and FIG. 13(B) where the stitching direction is set counterclockwise. In FIG. 13, reference symbol S and reference numeral 31 respectively denote a point where stitching is started and a seam. In addition, reference symbol P denotes a range where the perfect stitch is prepared; and H a range where the hitch stitch is formed. In both cases where the stitching directions are set clockwise and counterclockwise, the range H in which the hitch stitch is prepared is limited to approximately 15° and the perfect stitch is prepared in the remaining range of 345°. It is therefore preferred to employ a stitching method covering a wide range of stitching (or cloth-feeding direction); namely, a DP-type half-turn hook even in the case of the pattern stitch.

The present divisor therefore proposes the use of a DP-type half-turn hook for an automatic sewing machine. FIGS. 14 and 15 illustrate a DP-type half-turn hook in such a state that stitching is started after the thread is cut: FIG. 14 is a perspective view; and FIG. 15 a partial top view as viewed from the direction of an arrow D. In FIGS. 14 and 15, like reference characters designate like or corresponding parts or elements in FIGS. 8 to 10. Like the DB type, the sliding surface 10 is formed at the end of the needle thread 28 in the thread dividing portion 8 of the shuttle race body 2 and, the needle thread 28 is caused to move along the sliding surface 10. Therefore, the needle thread 28 may dig into the groove between the shuttle race ring 4 and the shuttle race body 2 because the shuttle race ring 4 is located in the direction in which the needle thread 28 moves. When the thread digs into the groove like this, it may be torn off or soiled. The digging of the thread starts from the surface 34 on which the shuttle race ring 4 abuts against the shuttle race body 2 as well as an end 30 in the direction in which the shuttle body rotates in the cutout 32 of the shuttle race ring 4; this portion is hereinafter called a digging portion.

SUMMARY OF THE INVENTION

An object of the present device is therefore to provide a DP-type half-turn hook capable of preventing a needle thread from digging into the groove between a shuttle race ring and a shuttle race body.

In order to solve the foregoing problems according to the present device, a half-turn hook for positioning a needle thread loop between a needle and a point where a bobbin thread on a bobbin is guided outward at the time of stitching, the half-turn hook comprises a shuttle race body having a sliding surface on which a needle thread is slid in the beginning of stitching; a rotatable shuttle body; a bobbin;

and a shuttle race ring with a cutout formed in its upper portion. In the half-turn hook, the surface where the shuttle body abuts against the shuttle race body and the end into which the rotating shuttle body digs, in the cutout of the shuttle race ring, is located closer to the rotating shuttle body than the sliding surface of the shuttle race body.

Although the needle thread moves along the sliding surface of the shuttle race body in the beginning of stitching after the thread is cut, the needle thread is prevented from digging into the groove between the shuttle race ring and the shuttle race body as surface where the shuttle body abuts against the shuttle race body and the end into which the rotating shuttle body digs, in the cutout of the shuttle race ring, is located closer to the rotating shuttle body than the sliding surface of the shuttle race body.

DETAILED DESCRIPTION OF THE PREFERRED EMBODIMENTS

Referring to the accompanying drawings, a description will subsequently be given of a half-turn hook embodying the present device.

Figure 1:
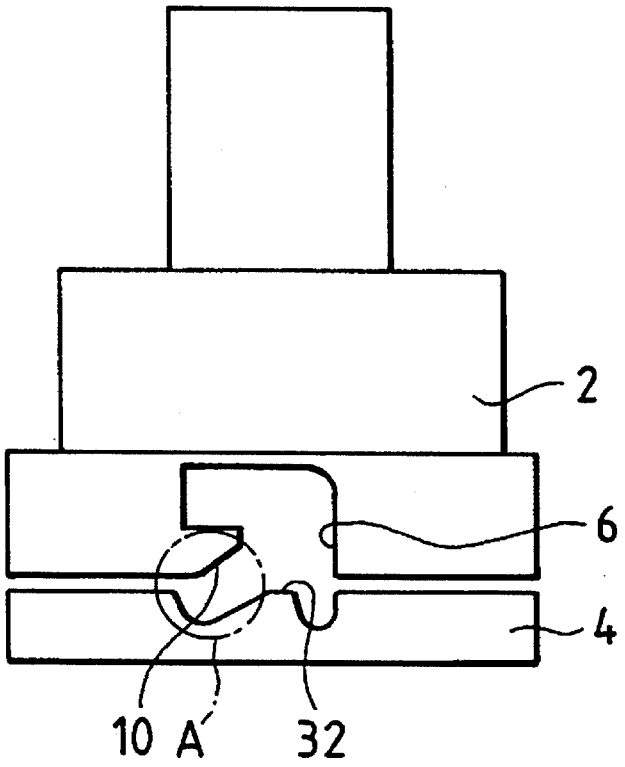
FIG. 1 is a top view of a half-turn hook embodying the present invention.
Figure 2:
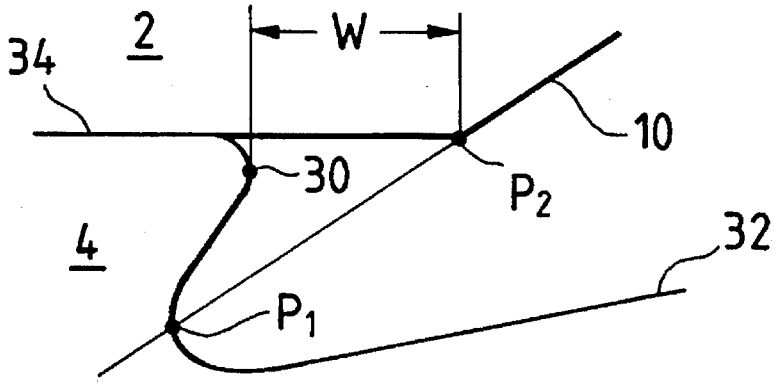
FIG. 2 is a detail view of a portion A of FIG. 1.
Figure 3:
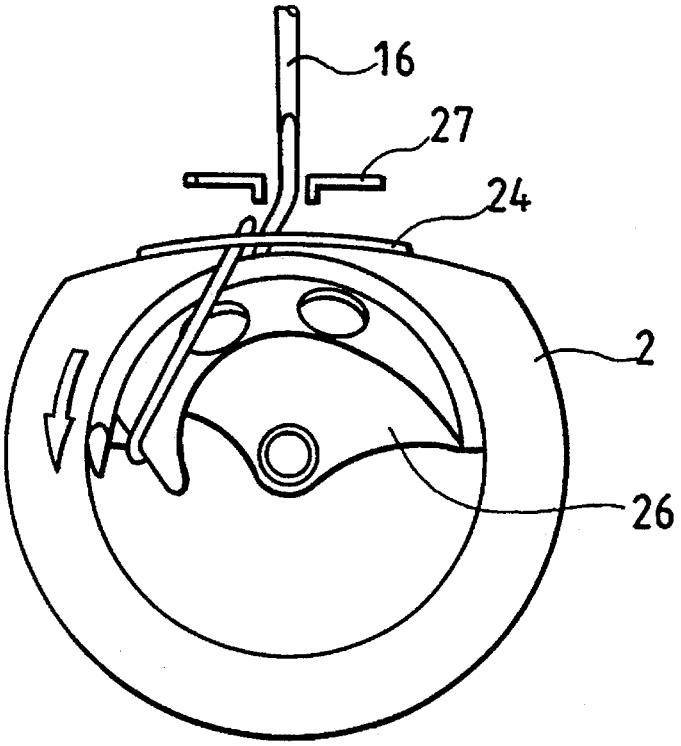
FIG. 3 is an elevational view of the embodiment of FIG. 1.
Figure 4:
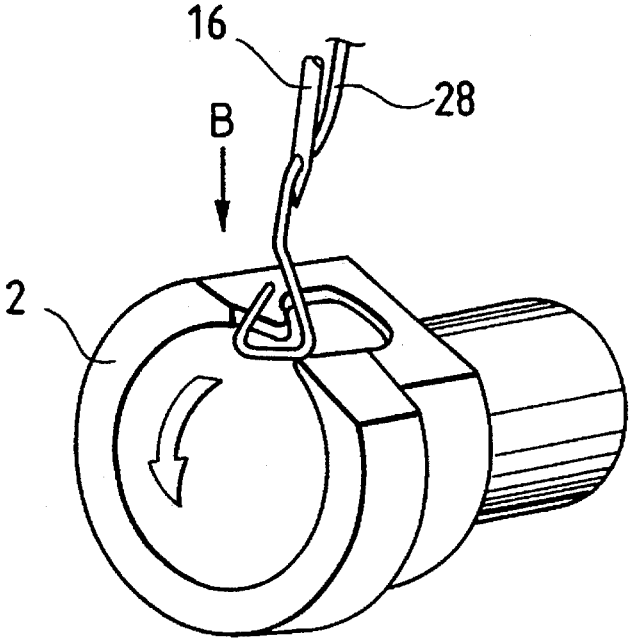
FIG. 4 is a perspective view of the embodiment of FIG. 1.
Figure 5:
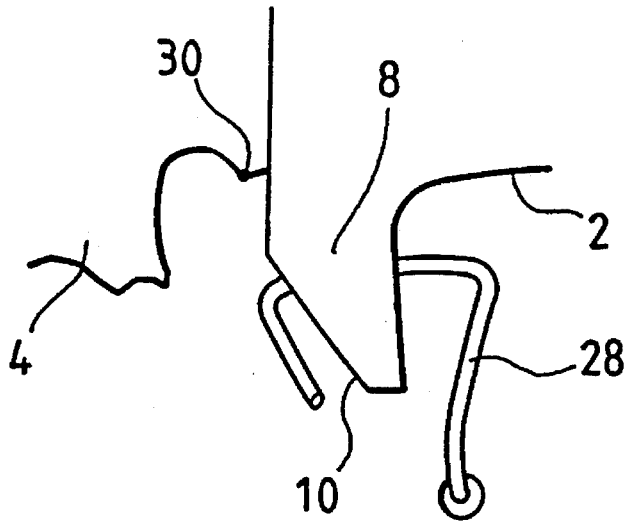
FIG. 5 is a partial enlarged top view as viewed from an arrow B of FIG. 4.
Figure 6:
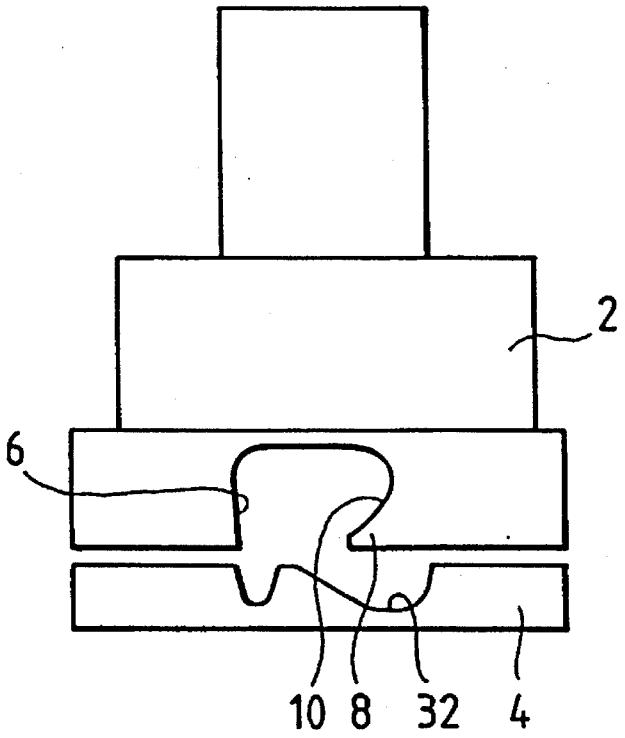
FIG. 6 PRIOR ART
FIG. 6 is a top view of a conventional DB-type half-turn hook.
Figure 7:
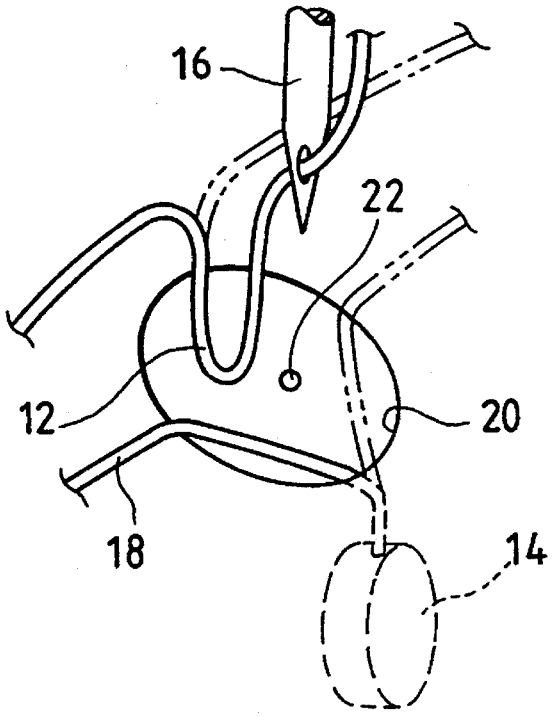
FIG. 7 PRIOR ART
FIG. 7 is a perspective view of positional relationship among a needle thread loop, a bobbin and a needle when a sewing machine using the DB-type half-turn hook is employed.
Figure 8:
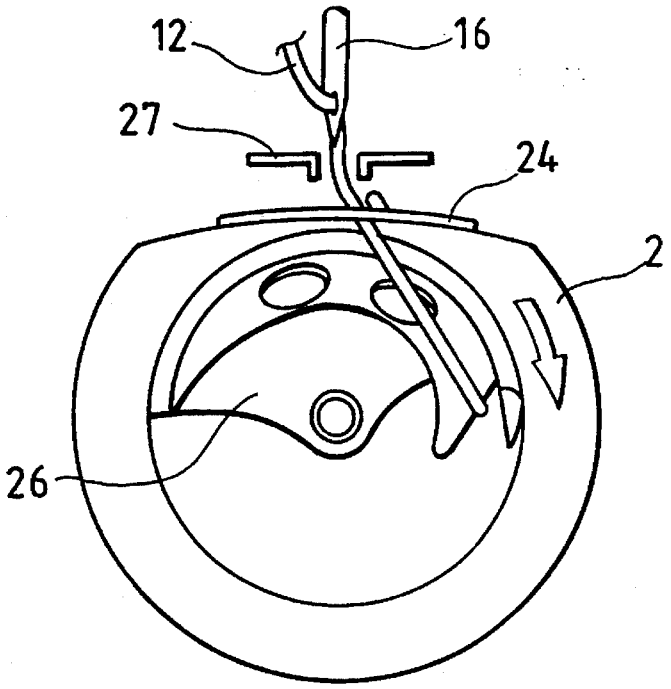
FIG. 8 PRIOR ART
FIG. 8 is elevational view of the DB-type half-turn hook of the sewing machine when sewing is started after the thread is cut.
Figure 9:
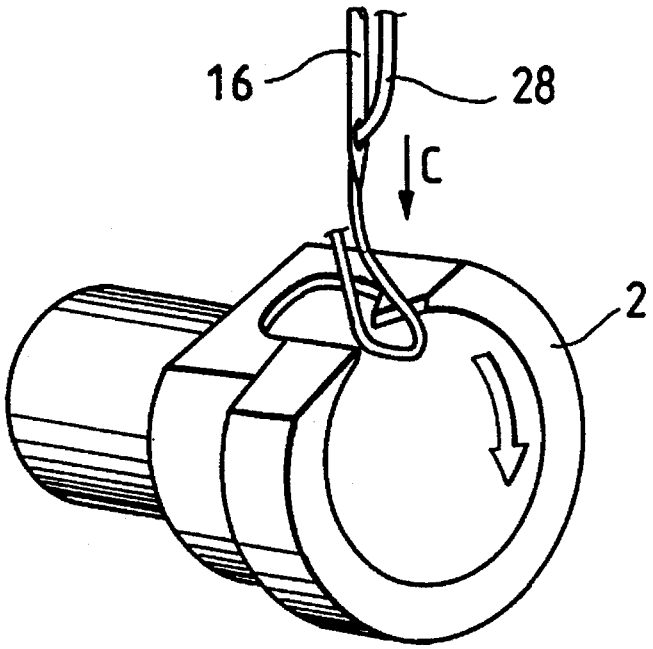
FIG. 9 PRIOR ART
FIG. 9 is a perspective view of the DB-type half-turn hook of the sewing machine when sewing is started after the thread is cut.
Figure 10:
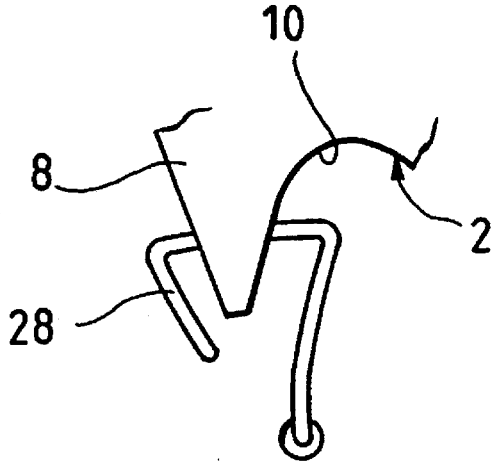
FIG. 10 PRIOR ART
FIG. 10 is a partial top view as viewed from an arrow C of FIG. 9.
Figure 11A:
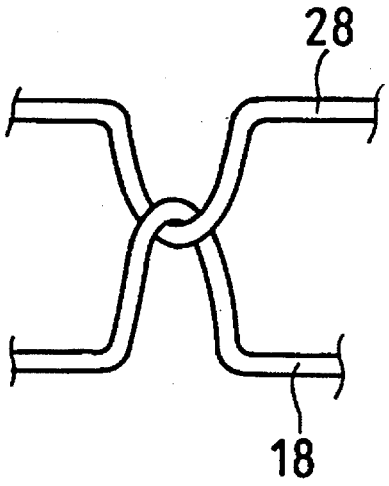
FIGS. 11(A) and 11(B) are diagrammatic views of seams of different types, 11(A) the perfect stitch; and 11(B) the hitch stitch.
Figure 11B:
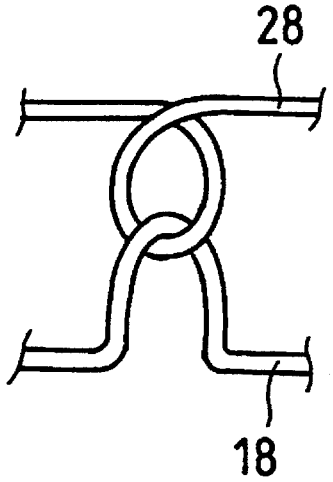
Figure 12:
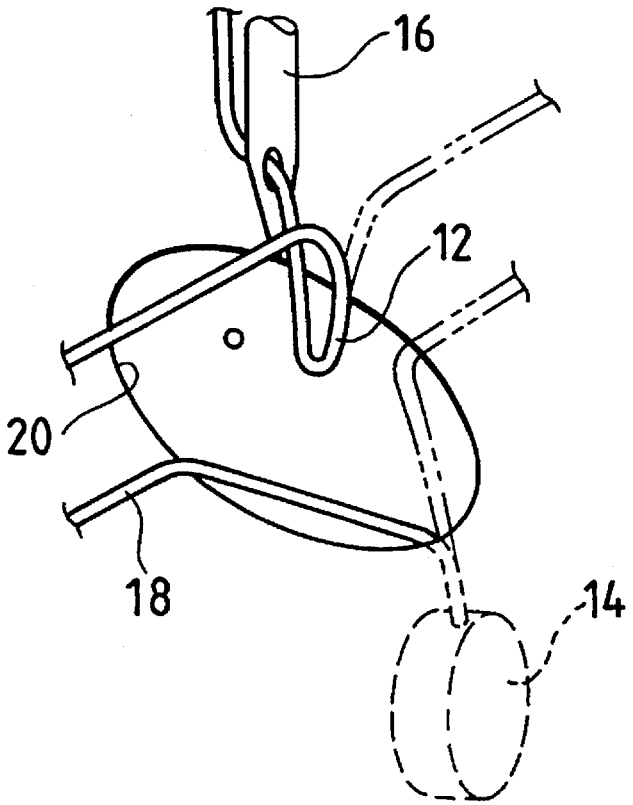
FIG. 12 is a perspective view of positional relationship among a needle thread loop, a bobbin and a needle when a sewing machine using the DP-type half-turn hook is employed.
Figure 13A:
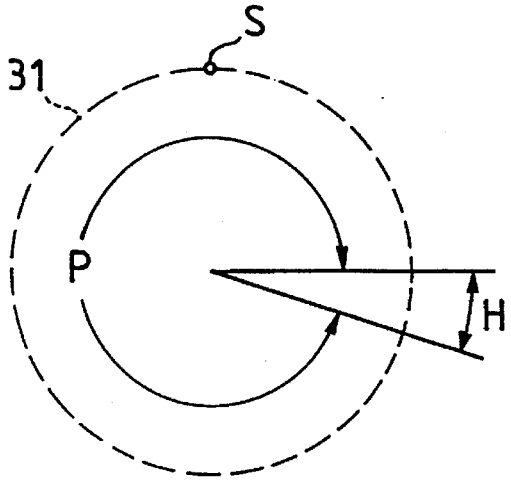
FIGS. 13(A) and 13(B) are diagrammatic views of circular seams resulting from tests for ensuring kinds of seams formed at the time of pattern sewing: 13(A) when the needle is directed clockwise; and 13(B) when the needle is directed counterclockwise.
Figure 13B:
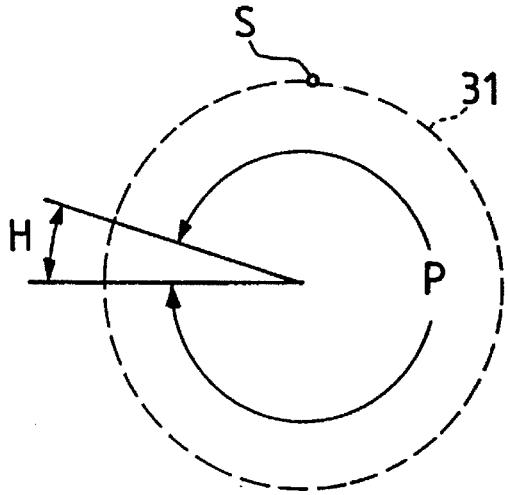
Figure 14:
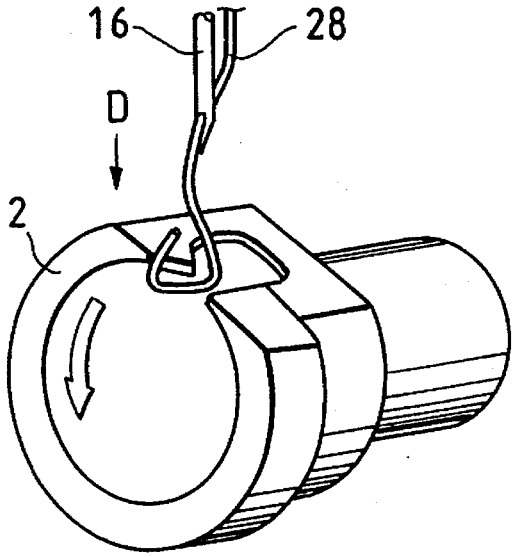
FIG. 14 is a perspective view of the DP-type half-turn hook when sewing is started after the thread is cut.
Figure 15:
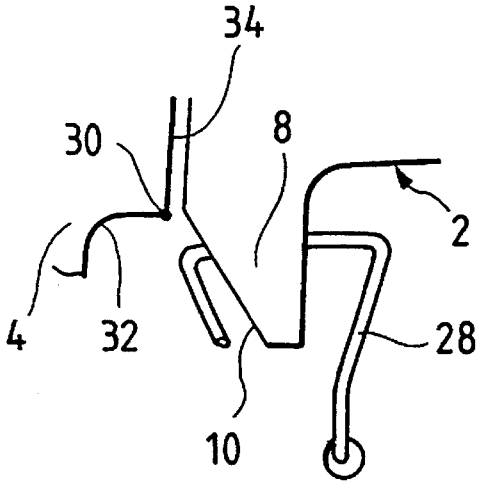
FIG. 15 is a partial top view as viewed from an arrow D of FIG. 14.

FIG. 1 is a top view of a half-turn hook embodying the present device; FIG. 2 a detail view of a portion A of FIG. 1; FIG. 3 an elevational view; FIG. 4 a perspective view; and FIG. 5 a partial enlarged top view as viewed from an arrow B of FIG. 4. FIGS. 3 to 5 illustrate the half-turn hook in such a state that sewing is started after the thread is cut.

In these drawings, like reference characters designate like parts or elements of FIGS. 6 to 15. The half-turn hook has a shuttle race body 2, a shuttle body, a shuttle bobbin (not shown), which are provided in the shuttle race body 2, and a shuttle race ring 4. A cutout 6 for use in vertically passing a needle 16 and a needle thread 28 therethrough is formed in the top surface of the shuttle race body 2. Moreover, a sliding surface 10 is provided in front (on the lower side of FIG. 1) of the thread dividing portion 8 of the shuttle race body 2, the sliding surface 10 being smoothly finished. A cutout 32 is also formed in the shuttle race ring 4.

Referring to FIG. 2, the configuration of the cutout 32 will be described. The digging portion 30 is located to the left (in the direction in which the need thread 28 moves) of the sliding surface 10. The point P1 where the extended line of the sliding surface 10 of the shuttle race body 2 intersects the cutout 32 of the shuttle race ring 4 is preferably sufficiently away (toward the shuttle race ring 4) from the surface 34 where the shuttle race body 2 abuts against the shuttle body 26. Given the end point of the sliding surface 10 as P2 and the digging portion 30 as P3, P3 is situated deeper (left side in FIG. 2) than P2 in the direction in which the hook rotates and P3 is also situated inside a line connecting P2 and P1. An angle between the line P2 - P1 and the contact face 34 is smaller than an angle between the line P3 - P1 and the contact face 34.

When the machine is used for sewing, the shuttle body 26 rotates counterclockwise when sewing is started after the thread is cut in FIGS. 3 and 4. Although the needle thread 28 moves along the sliding surface 10 of the shuttle race body 2, the needle thread 28 is prevented from digging into the groove as the digging portion 30 is positioned closer to the moving direction of the needle thread 28 than the sliding surface 10.

The DP-type half-turn hook according to the present device is capable of preventing the needle thread 28 from digging into the groove between the shuttle race ring 4 and the shuttle race body 2.

What is claimed is:

1. A half-turn hook for positioning a needle thread loop between a needle and a bobbin at the time of stitching, the half-turn hook comprising:

a shuttle race body having a lower portion having a surface, a cutout and a sliding surface formed in the cutout, and on which a needle thread is slid in the beginning of stitching, said sliding surface including an end point located at the surface of the lower portion;

a rotatable shuttle body;

a bobbin; and a shuttle race ring having an upper portion having a surface, and a cutout formed in the upper portion, the cutout including an end point located at the surface of the shuttle race ring, wherein the surface of the lower portion is adjacent the surface of the upper portion, and wherein the end point of the cutout of the shuttle race ring is located downstream in a loop taking direction of the rotatable shuttle body in comparison with the end point of the sliding surface of the shuttle race body.

2. A half-turn hook according to claim 1, wherein said needle thread loop moves along a line parallel to the surface of the lower portion of the shuttle race body, wherein said cutout of the upper portion of the shuttle race ring has a digging portion located along the line in which said needle thread loop moves, and wherein the half-turn hook being further defined by:

a first point located at the intersection of the cutout of the upper portion of the shuttle race ring and a line extending from said sliding surface of said shuttle race body, wherein the first point is located a distance away from a point where the rotatable shuttle body abuts against the surface of the lower portion of the shuttle race body;

a second point located at the end point of the sliding surface of the cutout of the shuttle race body;

a third point located at the digging portion, wherein the third point is spaced from the second point;

a first line formed by connecting the first point to the second point;

a second line formed by connecting the first point to the third point;

a third line formed parallel to the surface of the lower portion of the shuttle race body;

a first angle formed at the intersection of the first and third lines; and a second angle formed at the intersection of the second and third lines, wherein the first angle is smaller than the second angle.

* * * * *